US009676176B2

(12) United States Patent
Elter et al.

(10) Patent No.: US 9,676,176 B2
(45) Date of Patent: Jun. 13, 2017

(54) METHOD FOR CONTROLLING INKING IN A PRINTING PRESS WITH MACHINE-DEPENDENT COMPENSATION IN INKING AND DAMPENING UNITS

(75) Inventors: Peter Elter, Mühlhausen (DE); Nikolaus Pfeiffer, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 721 days.

(21) Appl. No.: 13/404,185

(22) Filed: Feb. 24, 2012

(65) Prior Publication Data

US 2012/0216695 A1 Aug. 30, 2012

(30) Foreign Application Priority Data

Feb. 24, 2011 (DE) ..... 10 2011 012 282

(51) Int. Cl.
*B41F 7/24* (2006.01)
*B41F 31/12* (2006.01)
*B41F 31/13* (2006.01)

(52) U.S. Cl.
CPC ..... *B41F 7/24* (2013.01); *B41F 31/12* (2013.01); *B41F 31/13* (2013.01)

(58) Field of Classification Search
CPC ..... B41F 7/00; B41F 7/02; B41F 7/24; B41F 31/12; B41F 31/13; B41F 33/00; B41F 33/0054; B41F 33/16; B41L 17/00; B41L 25/00; B41M 1/06
USPC ..... 101/130, 132.5, 147, 148, 451, 484
See application file for complete search history.

(56) References Cited

U.S. PATENT DOCUMENTS

| | | | | |
|---|---|---|---|---|
| 4,064,804 | A * | 12/1977 | Schweitzer | 101/451 |
| 5,520,113 | A | 5/1996 | Joss et al. | |
| 5,907,999 | A | 6/1999 | Lusar et al. | |
| 6,655,272 | B2 | 12/2003 | Hauck et al. | |
| 6,679,169 | B2 | 1/2004 | Anweiler et al. | |
| 6,810,810 | B2 | 11/2004 | Anweiler et al. | |
| 7,523,706 | B2 | 4/2009 | Schneider et al. | |
| 2001/0003955 | A1 | 6/2001 | Mayer et al. | |
| 2001/0006027 | A1 * | 7/2001 | Pfeiffer et al. | 101/425 |
| 2002/0073867 | A1 | 6/2002 | Anweiler et al. | |
| 2003/0084800 | A1 | 5/2003 | Anweiler et al. | |

(Continued)

FOREIGN PATENT DOCUMENTS

| | | | |
|---|---|---|---|
| DE | 3907584 | A1 | 9/1990 |
| DE | 19701219 | A1 | 7/1998 |
| DE | 19720954 | A1 | 12/1998 |

(Continued)

OTHER PUBLICATIONS

Machine translation of DE 19701219 to Anweiler et al. published on Jul. 23, 1998.*

*Primary Examiner* — Blake A Tankersley
(74) *Attorney, Agent, or Firm* — Laurence A. Greenberg; Werner H. Stemer; Ralph E. Locher

(57) ABSTRACT

A method for controlling the inking in a printing press includes compensation of an ink requirement in an inking unit and/or compensation of a dampening solution requirement in a dampening unit of the printing press in the event of a change in the printing speed. The printing speed profile or machine state prevailing before the instant of the change in the printing speed is taken into consideration in the compensation of the metering of ink or dampening solution.

7 Claims, 6 Drawing Sheets

(56) References Cited

U.S. PATENT DOCUMENTS

2008/0011171 A1 1/2008 Schneider et al.

FOREIGN PATENT DOCUMENTS

| | | | |
|---|---|---|---|
| DE | 10017800 | A1 | 6/2001 |
| DE | 10159698 | A1 | 6/2002 |
| DE | 10245702 | A1 | 5/2003 |
| DE | 102005013634 | A1 | 9/2006 |
| DE | 102006042883 | A1 | 3/2007 |
| DE | 102008049952 | A1 | 4/2010 |
| GB | 2424393 | A | 9/2006 |
| JP | H10250041 | A | 9/1998 |
| JP | 2002166527 | A | 6/2002 |
| WO | 2005115758 | A1 | 12/2005 |

* cited by examiner

METHOD FOR CONTROLLING INKING IN A PRINTING PRESS WITH MACHINE-DEPENDENT COMPENSATION IN INKING AND DAMPENING UNITS

CROSS-REFERENCE TO RELATED APPLICATION

This application claims the priority, under 35 U.S.C. §119, of German Patent Application DE 10 2011 012 282.6, filed Feb. 24, 2011; the prior application is herewith incorporated by reference in its entirety.

BACKGROUND OF THE INVENTION

Field of the Invention

The present invention relates to a method for controlling inking in a printing press with compensation of an ink requirement in an inking unit and/or compensation of a dampening solution requirement in a dampening unit of the printing press, in the event of a change in printing speed.

A satisfactory print quality is set in offset printing presses only when ink metering and dampening solution metering are adapted to the printing subject and are set correctly during the continuous printing phase. As soon as the continuous printing speed of the printing press is changed, the ink metering and dampening solution metering have to be adapted. Misprinted sheets or waste paper is produced in that transition phase, with the result that it is an aim, in the development of inking control systems in offset printing presses, to keep the transition phase as short as possible in the event of speed changes. One approach is so-called speed compensation which is known from German Published Patent Application DE 197 01 219 A1. In the method disclosed therein for controlling the inking, it is provided that the metering of the fluid which is to be applied to a printing material is changed as a function of the printing speed. In addition, in the event of a change in the printing speed, the fluid is transferred simultaneously with the printing speed change in a temporarily overdriven manner. The so-called speed compensation takes place by way of such overdriving, with the result that the time for carrying out speed changes in the transition phase of a printing press is reduced, as a result of which the print quality is improved during and after the performance of speed changes and the proportion of misprinted sheets or waste paper is reduced. In that speed compensation, substantially the continuous printing speed before the speed change and the continuous printing speed after the speed change are taken into consideration. However, it has been proven in practice that there are also further influencing variables which have an effect on the ink and dampening solution metering in the event of a change in the printing speed.

SUMMARY OF THE INVENTION

It is accordingly an object of the invention to provide a method for controlling inking in a printing press with machine-dependent compensation in inking and dampening units, which overcomes the hereinafore-mentioned disadvantages of the heretofore-known methods of this general type, which follows an integrated approach in the event of changes in the printing speed and, as far as possible, takes all factors which have an influence on inking into consideration in the event of a printing speed change.

With the foregoing and other objects in view there is provided, in accordance with the invention, a method for controlling inking in a printing press. The method comprises compensating an ink requirement in an inking unit and/or a dampening solution requirement in a dampening unit of the printing press upon a change in printing speed, and taking a printing speed profile or course or a machine state prevailing before an instant of change in the printing speed into consideration in a compensation of metering of ink and/or dampening solution.

The method according to the invention presupposes the use of a control computer for controlling the ink and/or dampening solution metering in a printing press. In this case, the control computer detects the printing speed profile and/or the machine state of the running or stationary printing press and, as a function of the detected printing speed profile or detected machine state, decides which compensation is carried out in the metering of ink or dampening solution in the event of printing speed changes, in order to keep misprinted sheets or waste paper as low as possible during the printing speed change. The machine state is to be considered, in particular, as the stopping of the printing press and the restarting without washing of a rubber blanket in the printing unit of the printing press, stopping of the printing press and restarting with preceding washing of the rubber blanket in the printing unit of the printing press, start-up of the printing press after an ink input, and start-up after a print job change. The printing speed profile is to be considered as all changes in the printing speed before the instant of the current change in the printing speed. This detection and evaluation of the machine states and printing speed profiles before the instant of the change in the printing speed make optimum speed compensation possible with regard to the metering of ink or dampening solution and thus reduce the production of misprinted sheets or waste paper to a minimum in the event of a change in the printing speed. The present invention can be used in all offset printing presses, in particular sheet-fed printing presses, web-fed rotary printing presses as well as offset printing presses with anilox inking units.

In accordance with another mode of the invention, a different speed compensation during the ink metering or dampening solution metering is carried out as a function of the machine state or the speed profile before the instant of the speed change. According to the present invention, the speed compensation for metering dampening solution and ink does not necessarily take place at the same time and in parallel as in the prior art, but rather the speed compensation of ink and dampening solution can be configured differently, depending on which machine state or speed profile was present before the instant of the speed change. The number of machine states and the speed profile thus result in numerous possible combinations for the different actuation of ink metering and dampening solution metering during the speed compensation. In this way, a different speed compensation during the ink metering and dampening solution metering is carried out depending on the machine state and speed change and the preceding speed profile.

In accordance with a further mode of the invention, if there is too much ink in the inking unit, the speed compensation of the ink metering is carried out in a delayed manner in the event of an increase in the printing speed, but the compensation of the dampening solution metering is carried out immediately. In this way, the excess of ink is first of all reduced, before more ink passes into the inking unit again as a result of the speed compensation of the ink metering during the speed change. However, the dampening solution metering is carried out immediately, independently of the former.

In accordance with an added mode of the invention, if there is too little ink in the inking unit, the speed compensation of the ink metering is carried out immediately in the event of an increase in the printing speed, but the speed compensation of the dampening solution metering is carried out in a delayed manner in contrast. In this case, first of all the lack of ink in the inking unit is rectified by the immediate speed compensation of the ink metering, and the dampening solution metering is likewise only raised later. This avoids having too much dampening solution applied to the printing plate in comparison with the ink as a result of an immediate speed compensation of the dampening solution metering.

In accordance with an additional mode of the invention, the delay takes place proportionally to the speed difference. This means that the greater the speed change, the later the occurrence of the speed compensation of that component which is carried out in a delayed manner in the respective method step.

In accordance with yet another mode of the invention, if the machine speed during the ink input is greater than the continuous printing speed or the printing press is started up after washing of the rubber blanket on the blanket cylinder, the speed compensation of the ink metering and the speed compensation of the dampening solution metering are carried out immediately. In the machine states ink input and washing of the rubber blanket, the machine is situated in an unstable state with an empty inking unit, with the result that both ink and dampening solution can be metered immediately in an increased manner through the control of the speed compensation, in order to thus minimize the time of the production of misprinted sheets or waste paper.

In accordance with yet a further mode of the invention, if the machine speed during the ink input is lower than the continuous printing speed or a change is made during the print job change to an identical or higher continuous printing speed than in the preceding print job, the speed compensation of the ink metering is carried out immediately and the speed compensation of the dampening solution metering is carried out in a delayed manner. In this refinement of the invention, the initially also continuous printing speed of the preceding print job is evaluated and, in the case of an identical or higher continuous printing speed in comparison with the preceding print job, an immediate speed compensation during the ink metering is carried out with delayed speed compensation during the dampening solution metering.

In accordance with a concomitant mode of the invention, during start-up of the printing press without washing of the rubber blanket on the blanket cylinder or in the case of the print job change at a lower continuous printing speed than in the case of the preceding print job, the speed compensation of the ink metering is carried out in a delayed manner and the speed compensation of the dampening solution metering is carried out immediately. If the continuous printing speed during the following print job is lower than during the preceding print job, first of all a certain dissipation of ink is to take place in the inking unit, before the speed compensation of the ink metering is carried out. This is not the case for the dampening solution metering, with the result that the dampening solution metering is carried out immediately.

Other features which are considered as characteristic for the invention are set forth in the appended claims.

Although the invention is illustrated and described herein as embodied in a method for controlling inking in a printing press with machine-dependent compensation in inking and dampening units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
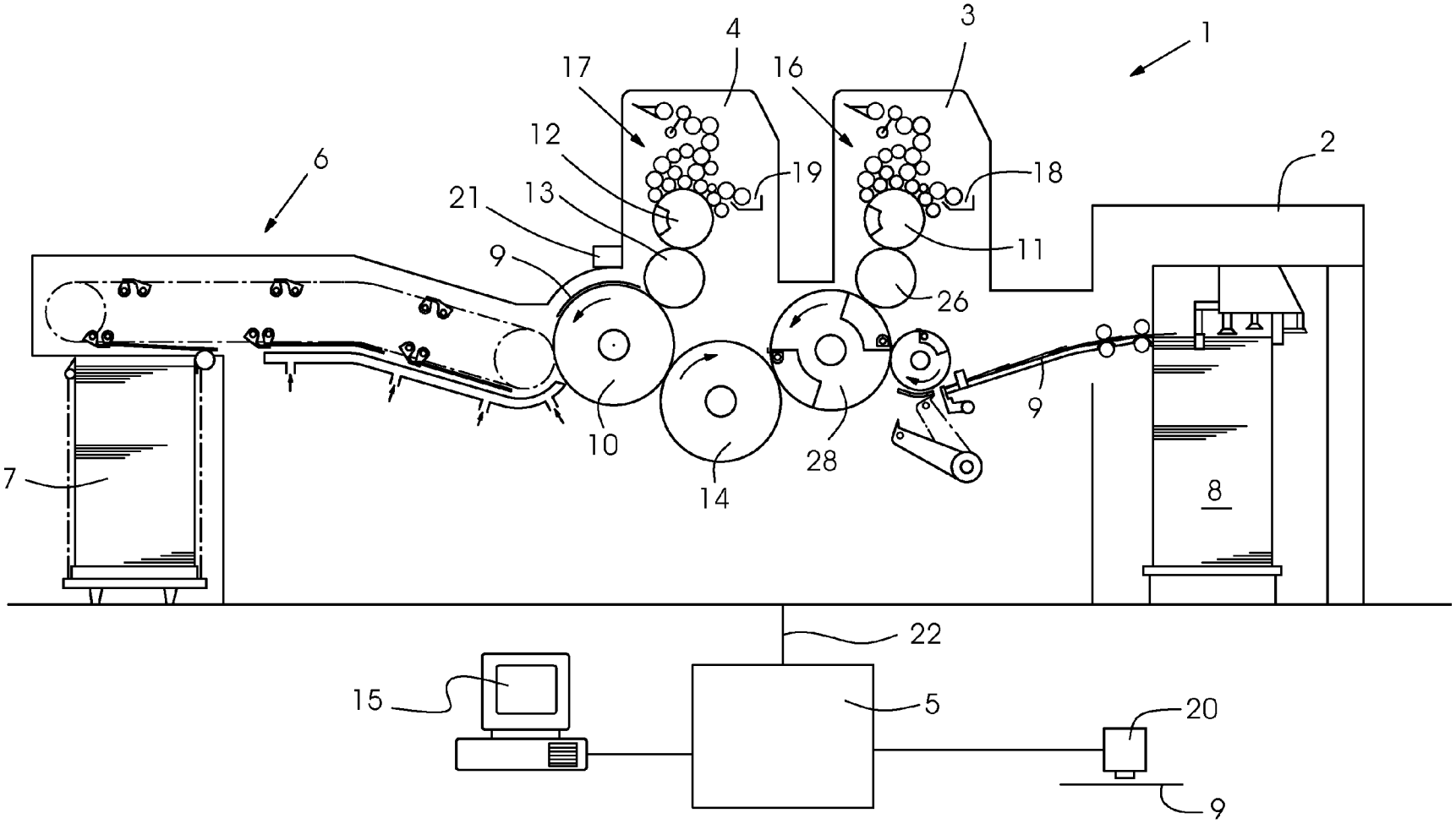
FIG. 1 is a diagrammatic, longitudinal-sectional view of a sheet-fed offset printing press having a control computer which is programmed according to the invention.

Referring now to the figures of the drawings in detail and first, particularly, to FIG. 1 thereof, there is seen a printing press 1 which has two printing units 3, 4, each having a respective inking unit 16, 17 and dampening unit 18, 19. The inking units 16, 17 serve for ink metering and have electric actuating motors which are connected to a control computer 5 of the printing press 1. The ink which is metered in the inking units 16, 17 can be dampened by way of the dampening units 18, 19. The dampening solution metering in the dampening units 18, 19 can also be controlled by the control computer 5. The metered and dampened ink is first of all transferred onto plate cylinders 11, 12 carrying printing plates in the printing units 3, 4, and from there onto blanket cylinders 13, 26. From there, a printing image is then transferred in a press nip between the blanket cylinders 13, 26 and impression cylinders 10, 28 onto printing sheets 9 which are situated in the printing press 1. The printing materials or sheets 9 are transferred between the two printing units 3, 4 through the use of a transport cylinder 14. Required new printing sheets 9 are raised up from a feed stack 8 in a feeder 2 through the use of a suction apparatus and are fed to the first printing unit 3 over a suction belt table. Following the second printing unit 4, the finished printing materials 9 are transferred to gripper chains in a delivery 6 and are deposited on a delivery stack 7.

The control computer 5 of the printing press 1 is connected over communications links 22 to all of the electric adjusting motors of the printing press 1, in order to be able to perform the desired adjusting operations. In particular, the control computer 5 can adjust individual inking zones in the inking units 16, 17 in order to meter the ink. Moreover, a display screen 15 is connected to the control computer 5. The operating state of the printing press 1 is shown on the display screen 15 and inputs of the operating staff are possible through the display screen 15. Furthermore, an external color measuring instrument 20 is connected to the control computer 5 through a communications link 22. The color of finished printed sheets 9 which are deposited in the delivery stack 7 can be measured by way of the external color measuring instrument 20. To this end, the printed sheets 9 have to be removed from the delivery stack 7 by the operating staff and have to be placed under the color measuring instrument 20. Furthermore, the printing press 1 has an inline color measuring device 21 at the outlet or exit of the second printing unit 4, which can likewise measure the color of the printed sheets 9. The produced printed sheets 9 can have their color measured continuously by way of the inline color measuring device 21, with the result that color measured values can be transmitted continuously to the control computer 5 by the inline color measuring instrument 21. In the control computer 5, the color measured values which are detected in this way are compared with a setpoint coloring S which is predefined by the operating staff and is dependent on the respective print job and the associated printing original. The setpoint coloring S serves as a target value for a corresponding ink presetting characteristic curve in the inking units 16, 17 of the printing press 1.

Figure 2:
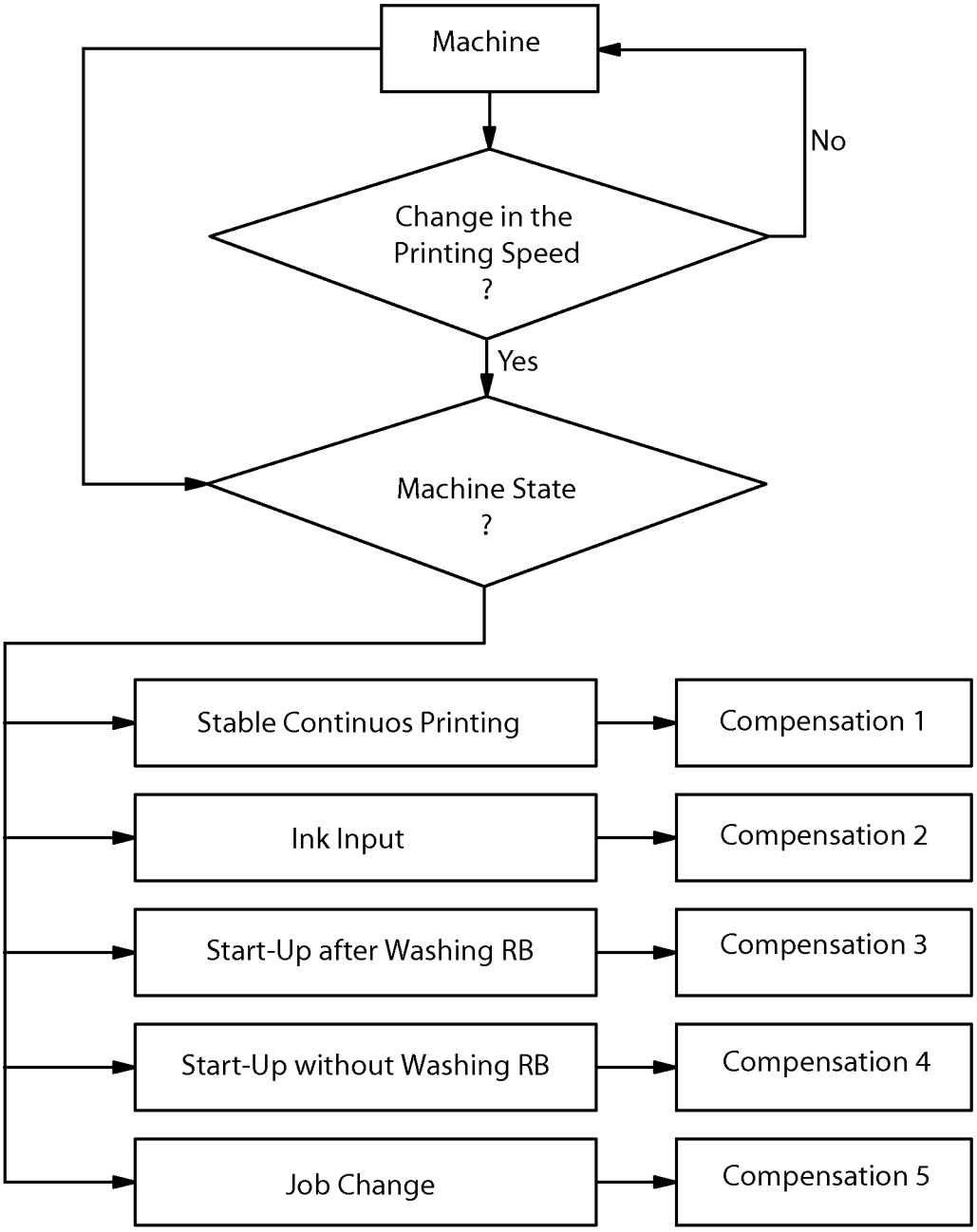
FIG. 2 is a flow chart showing an overview of decision criteria of the control computer during selection of a suitable speed compensation of ink and dampening solution.

FIG. 2 depicts decision criteria for the control computer 5 which detects the machine state and the change in the printing speed. First of all, the control computer 5 determines whether or not a change in the printing speed is carried out. If this is not the case, nothing is changed about the ink and dampening solution metering. If, however, the control computer 5 has determined a change in the printing speed, the machine state is retrieved. By way of example, but not exclusively, five machine states which the control computer 5 retrieves through sensors or a running printing program of the printing press 1 are shown in FIG. 2. If a change in the printing speed takes place in a stable continuous printing phase, a speed compensation 1 is performed. If the printing press 1 is currently situated in an ink input phase, a printing speed compensation 2 is performed. During start-up of the printing press 1, after washing the rubber blanket (RB) on the blanket cylinder 13, 26, a speed compensation 3 takes place. If the printing press 1 is started up without washing of the rubber blanket on the blanket cylinder 13, 26, a speed compensation 4 takes place. If there is a print job change, a speed compensation 5 is performed. These five speed compensations are shown in the following FIGS. 3 to 7.

Figure 3:
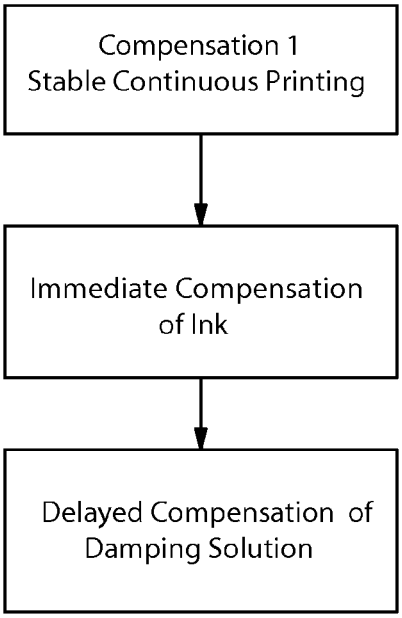
FIG. 3 is a flow chart showing a speed compensation during a change in the printing speed in a stable continuous printing phase.

FIG. 3 depicts the speed compensation 1 which is performed during a change in the printing speed in the stable continuous printing phase. In the stable continuous printing phase, the printing unit 3, 4 is situated in a stationary stable state. If, however, the printing speed is increased, more ink and dampening solution have to be supplied. Since, however, the increase in the dampening solution metering is discernible much more rapidly than the increase in the ink metering, the dampening solution metering is initiated subsequently in a delayed manner, in order to prevent a reduction in the ink density on the printing material 9. In the case of a reduction in the printing speed, however, a distinction has to be made as to whether a new stable state is aimed for or the printing press 1 is stopped. If the printing press 1 is to be stopped, the compensations of ink and dampening solution take place immediately. Otherwise, the procedure is as in the case of an increase in the printing speed.

Figure 4:
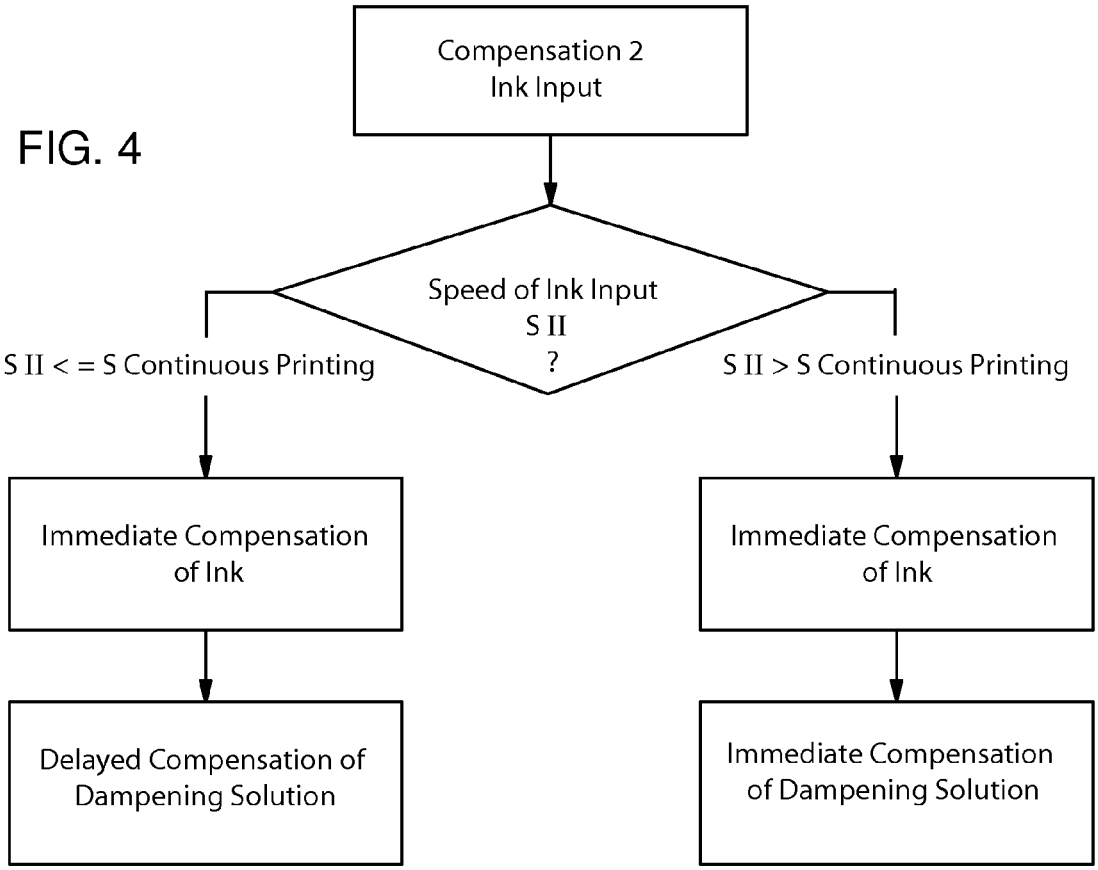
FIG. 4 is a flow chart showing a speed compensation during ink input as a function of a continuous printing speed of a current print job in comparison with a speed during ink input.

In FIG. 4, a speed compensation takes place during the ink input. In this machine state, the printing unit 3, 4 is not situated as a rule in a stationary stable state. The ink input usually takes place at a different speed than at a continuous printing speed. The speeds of the ink input and continuous printing therefore have to be taken into consideration in this case. If the ink input speed S II is lower than the continuous printing speed S Continuous Printing, the ink has to be compensated immediately and dampening solution metering has to be compensated in a delayed manner, in order to achieve equalization as rapidly as possible. If, however, the ink input speed S II is greater than the continuous printing speed S Continuous Printing, this leads to an excessive supply of ink, and ink and dampening solution are compensated immediately.

Figure 5:
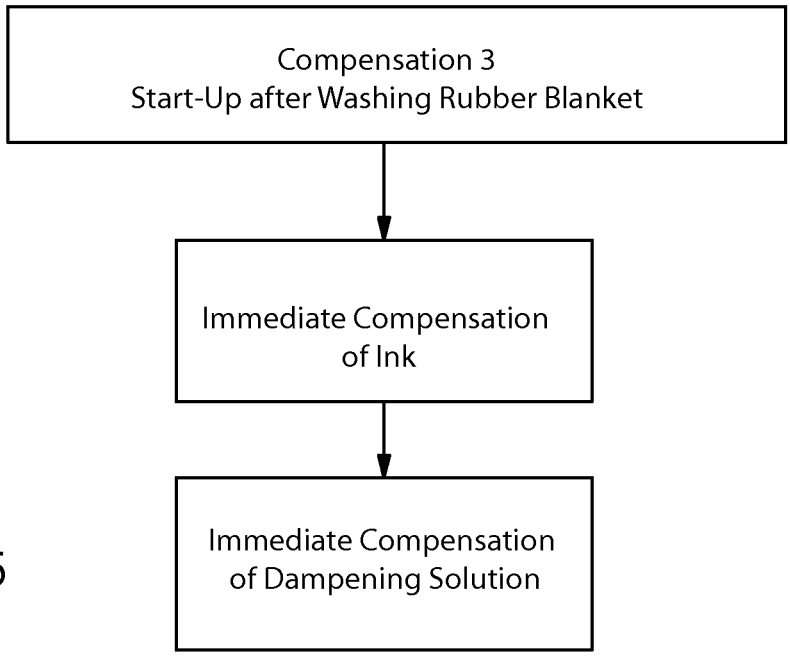
FIG. 5 is a flow chart showing a speed compensation during start-up of the printing press after washing of a rubber blanket.

A further machine state illustrated in FIG. 5 is the start-up of the printing press 1 after washing of the rubber blanket on the blanket cylinder 13, 26. In this case, that ink quantity which corresponds to the continuous printing state is situated in the printing unit 3, 4. Since, however, the resistance of the printing unit 3, 4 as a rule rises at higher printing speeds, the ink quantity is too great for the starting speed. However, the corresponding ink quantities are missing at the start on the rubber blankets of the blanket cylinders 13, 26. The first printed sheets 9 are therefore usually underinked, for which reason ink and dampening solution are compensated immediately, in order to avoid such underinking.

Figure 6:
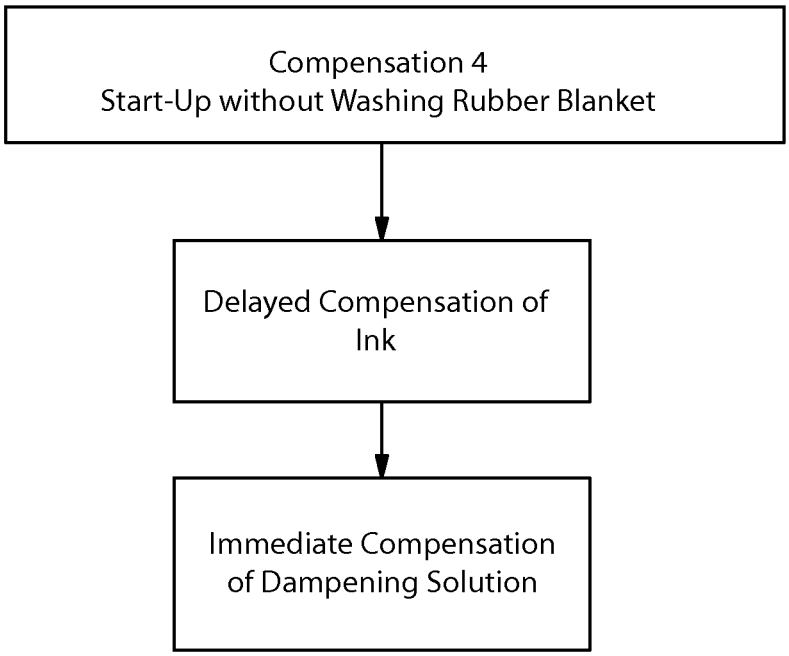
FIG. 6 is a flow chart showing a speed compensation during start-up of the printing press without washing of the rubber blanket.

FIG. 6 illustrates speed compensation during start-up of the printing press 1 without washing of the rubber blanket on the blanket cylinder 13, 26. That ink quantity which corresponds to the continuous printing state is also situated in the printing unit 3, 4 in this case. Since, however, the rubber blanket is not washed, ink is still situated correspondingly on the rubber blanket. Since the resistance of the printing unit 3, 4 as a rule rises at higher speeds, the ink quantity is too great for the starting speed. In this case, this leads to clear overinking of the first sheets 9. In order to avoid such overinking, the dampening solution is compensated immediately and the ink metering is initiated subsequently in a delayed manner.

Figure 7:
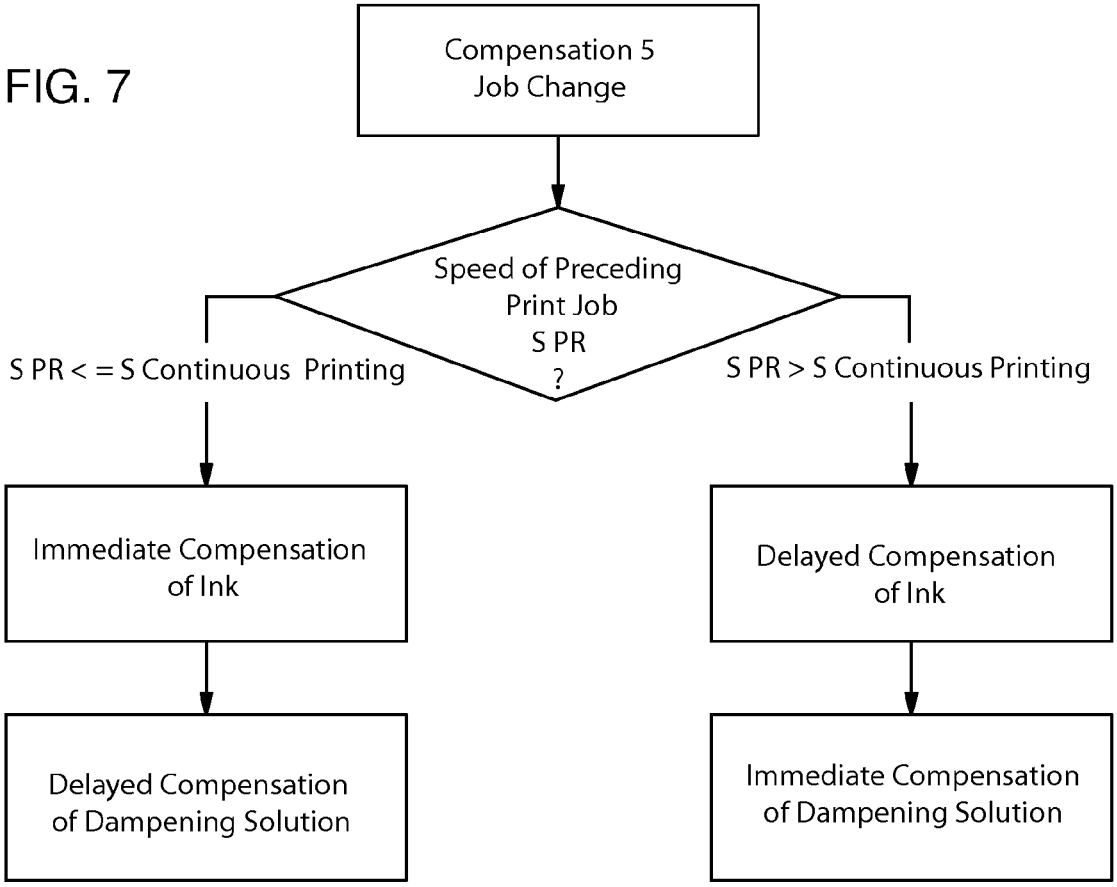
FIG. 7 is a flow chart showing a speed compensation during a print job change as a function of the continuous printing speed of the current print job in comparison with that of a preceding print job.

FIG. 7 shows the speed compensation after the print job change. In this case, the state is similar to after an ink input. The printing unit 3, 4 is not situated as a rule in a stationary stable state. The most important influencing parameter in this case is the printing speed of the preceding print job S PR. If this printing speed S PR is greater than that of the following job S Continuous Printing, the ink quantity in the inking unit is too great; if it is lower, the ink quantity is too small. In the first case, the ink is therefore compensated in a delayed manner and the dampening solution is compensated immediately, in order to dissipate the excessive ink quantity. In the second case, the ink is compensated immediately and the dampening solution metering is compensated in a delayed manner, in order to obtain correspondingly more ink in the inking unit 16, 17.

Figure 8:
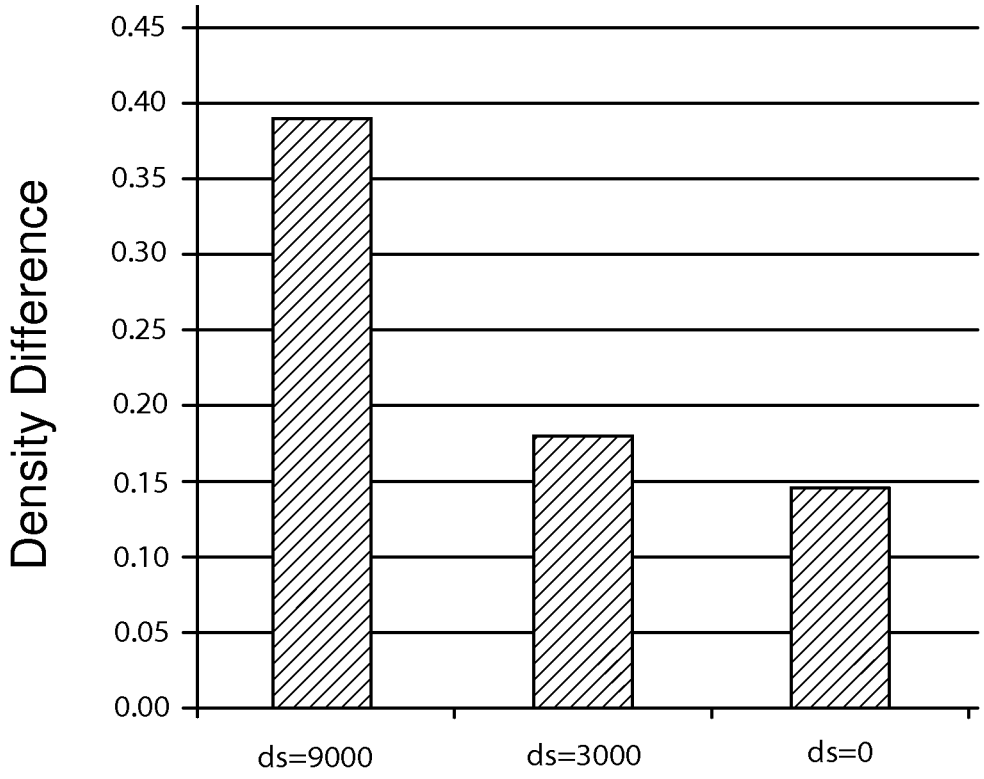
FIG. 8 is a diagram showing a relationship of printing speed compensation for overdriving inking after washing of the rubber blanket to printing speed difference.

FIG. 8 shows the start-up behavior of the printing press 1 during restarting of the printing press after washing of the rubber blanket. In this case, the printing speed difference (ds), that is to say the speed difference between the starting sheet and the continuous printing speed S Continuous Printing, is plotted on the x axis, and the difference in the ink density which results from the overinking during restarting after washing of the rubber blanket, is plotted on the y axis. The greater the printing speed difference, the greater the difference in the ink density.

The invention claimed is:

1. A method for controlling inking in a printing press, the method comprising the following steps:

compensating metering of at least one of ink in an inking unit or dampening solution in a dampening unit of the printing press upon a change in printing speed; and taking a printing speed profile including all changes in the printing speed before an instant of the change in the printing speed or a machine state prevailing before the instant of the change in the printing speed into consideration in the compensation of metering of at least one of the ink or the dampening solution.

2. The method according to claim 1, which further comprises selecting the machine state as either a stable continuous printing phase, a start-up after washing a rubber blanket, a start-up without washing the rubber blanket or a print job change.

3. The method according to claim 1, which further comprises, if there is too much ink in the inking unit, carrying out the compensation of the ink metering in a delayed manner upon an increase in the printing speed, but carrying out the compensation of the dampening solution metering immediately.

4. The method according to claim 1, which further comprises, if there is too little ink in the inking unit, carrying out the compensation of the ink metering immediately upon an increase in the printing speed, but carrying out the compensation of the dampening solution metering in a delayed manner.

5. The method according to claim 3, which further comprises carrying out the delay proportionally to a speed difference.

6. The method according to claim 4, which further comprises carrying out the delay proportionally to a speed difference.

7. The method according to claim 1, which further comprises carrying out the compensation of the ink metering in a delayed manner and carrying out the compensation of the dampening solution metering immediately in a printing press having a blanket cylinder with a rubber blanket, during a start-up of the printing press without washing the rubber blanket on the blanket cylinder or upon a print job change at a lower continuous printing speed than in a preceding print job.

* * * * *